US005421090A

United States Patent [19]

Chiou

[11] Patent Number: 5,421,090

[45] Date of Patent: Jun. 6, 1995

[54] STRUCTURE OF SCISSORS

[75] Inventor: Lian-Jen Chiou, Taichung Hsien, Taiwan, Prov. of China

[73] Assignee: Ding Wei Enterprises, Inc., Taichung Hsien, Taiwan, Prov. of China

[21] Appl. No.: 193,551

[22] Filed: Feb. 8, 1994

[51] Int. Cl.[6] ..... B26B 13/08

[52] U.S. Cl. ..... 30/254; 30/355

[58] Field of Search ..... 30/254, 353, 355, 357, 30/226, 230, 255, 256, 257, 258, 259, 260, 261, 262, 244, 252, 253; 83/847

[56] References Cited

U.S. PATENT DOCUMENTS

| | | | |
|---|---|---|---|
| 465,384 | 12/1891 | Morgan | 30/226 X |
| 667,914 | 2/1901 | Klever, Jr. | 30/226 X |
| 2,284,664 | 6/1942 | Kissling | 30/260 X |
| 4,250,619 | 2/1981 | Buerkert et al. | 30/230 |
| 4,658,456 | 4/1987 | Tsai | 7/135 |

FOREIGN PATENT DOCUMENTS

| | | | |
|---|---|---|---|
| 207891 | 12/1923 | United Kingdom | 30/254 |
| 258452 | 9/1926 | United Kingdom | 30/355 |
| 847928 | 9/1960 | United Kingdom | 30/230 |
| 1441988 | 7/1976 | United Kingdom | 30/355 |

*Primary Examiner*—Eugenia Jones

*Attorney, Agent, or Firm*—Beveridge, DeGrandi, Weilacher & Young

[57] ABSTRACT

A scissors includes two blades pivoted together in the middle, each blade having a handle unit at one end and a cutting unit at an opposite end, wherein the cutting unit of either blade has a respective wave-like cutting edge, the wave-like cutting edges of the two cutting units holding down the thing to be cut when they are moved to slide past each other.

4 Claims, 3 Drawing Sheets

STRUCTURE OF SCISSORS

BACKGROUND OF THE INVENTION

The present invention relates to a scissors, and relates more particularly to such a scissors which holds down the thing to be cut when the cutting edges thereof are moved to slide past each other.

A regular scissors, as shown in FIG. 1, is generally comprised of two blades pivoted together in the middle, each blade having handle unit at one end and a cutting edge at an opposite end. When the scissors is operated to slide the cutting edges past each other, things are cut. This structure of scissors is not suitable for cutting smooth and shiny foods such as fishes, meat, etc., because the cutting edges of the blades are made straight, and they cannot hold down the things to be cut.

SUMMARY OF THE INVENTION

The principal object of the present invention is to provide a scissors which holds down the thing to be cut when the cutting edges thereof are moved to slide past each other.

According to one aspect of the present invention, the cutting edge of either blade is made wave-like, and therefore the thing to be cut can be firmly retained between the cutting edges of the two blades when the two blades are moved to slide past each other.

According to another aspect of the present invention, the cutting edge of either blade has a series of smooth-edged teeth longitudinally aligned at the front end, and a series of sharp-edged teeth longitudinally aligned in the middle and at the rear end. The teeth hold down the thing to be cut during the operation of the scissors.

DETAILED DESCRIPTION OF THE PREFERRED EMBODIMENT

Figure 1:
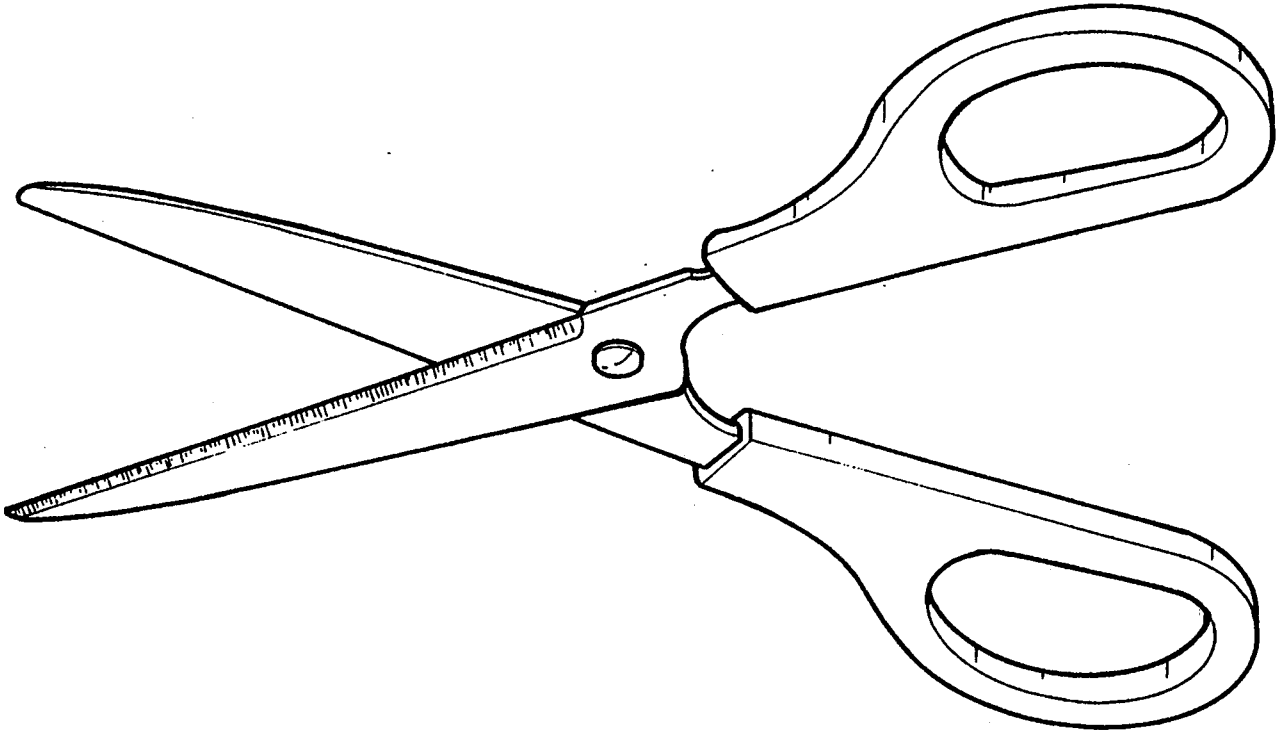
FIG. 1 PRIOR ART
FIG. 1 is an elevational view of a pair of scissors according to the prior art.
Figure 2:
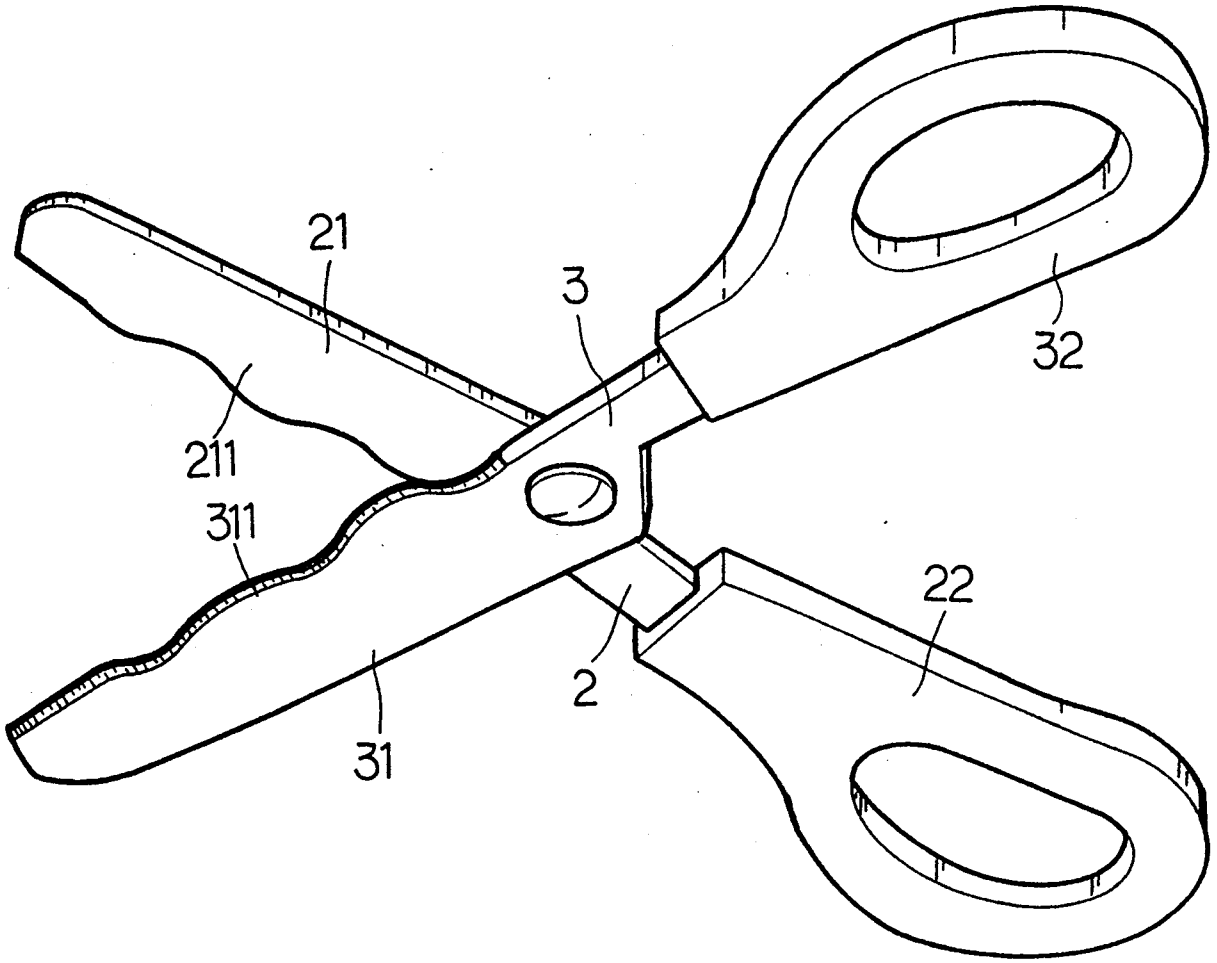
FIG. 2 is an elevational view of a pair of scissors according to one embodiment of the present invention.

Referring to FIG. 2, a scissors is comprised of two blades 2 and 3 pivoted together in the middle, each blade 2 or 3 having a handle unit 22 or 32 at one end and a cutting unit 21 or 31 at an opposite end. The cutting unit 21 or 31 has a wave-like cutting edge 211 or 311. When the scissors is operated, the wave-like cutting edges 211 and 311 slide past each other to cut things. This structure of scissors is most suitable for cutting fishes, meat, etc., because the wave-like cutting edges 211 and 311 hold down the fish, meat, etc., while cutting. Therefore, the thing to be cut will not slip away, and can be quickly cut.

Figure 3:
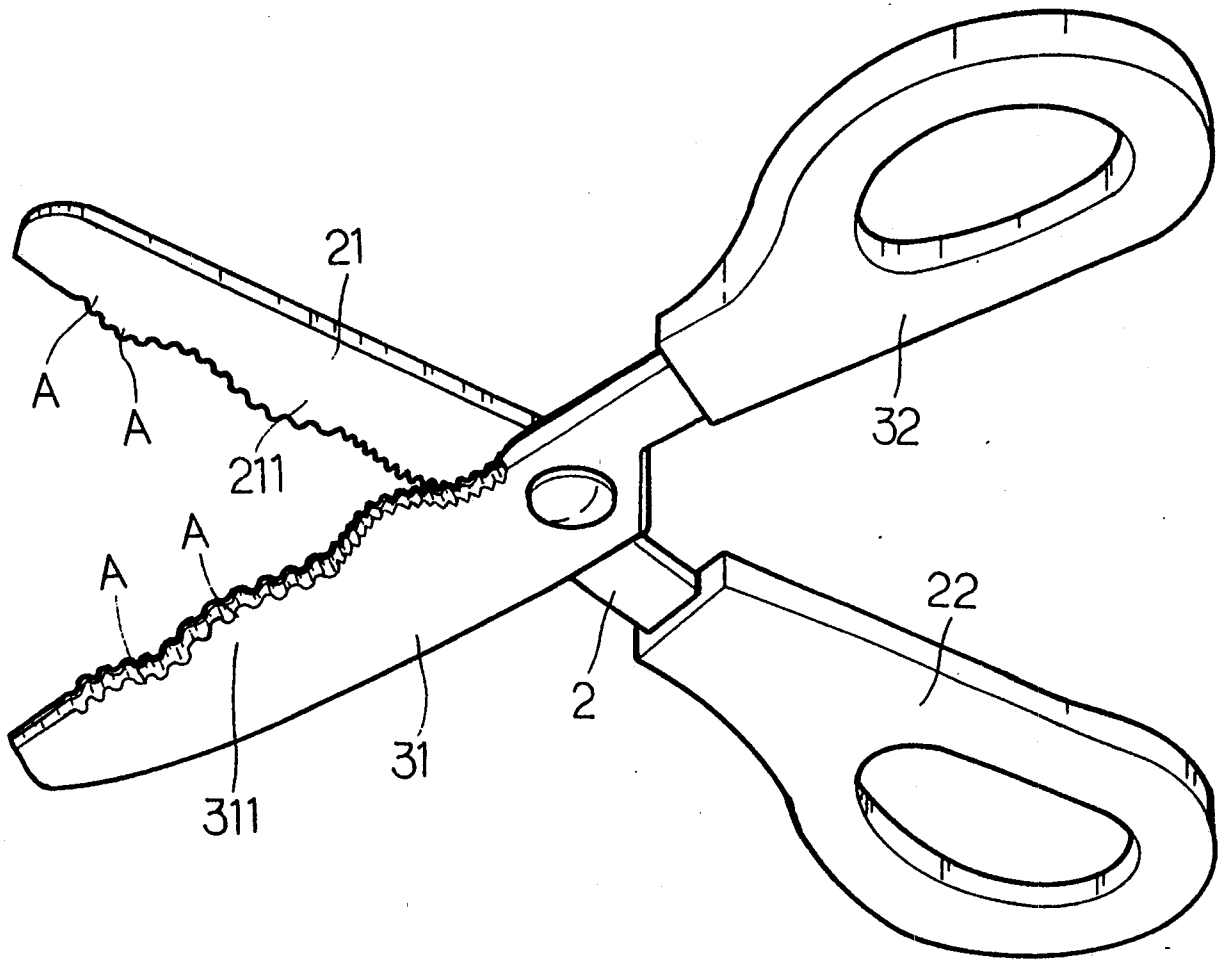
FIG. 3 shows an alternate form of the present invention.

Referring to FIG. 3, therein illustrated is an alternate form of the present invention. Teeth A may be made on the cutting edges 211 and 311 along the length. The teeth A on the front end of either cutting edge 211 or 311 are made smooth-edged while the teeth on the middle and rear end of either cutting edge 211 or 311 are made sharp-edged. By means of the teeth A, the thing to be cut can be firmly retained between the cutting units 21 and 31.

What is claimed is:

1. A scissors, comprising:

two blades pivoted together in a middle portion thereof, each blade having a handle unit at one end and a cutting unit at an opposite end, wherein the cutting unit of at least one blade has a wave-like cutting edge including a plurality of waves and a series of teeth along the cutting edge, such that each wave of the wave-like cutting edge includes a plurality of said teeth, wherein the wave-like cutting edge of said cutting unit holds down a thing to be cut when the cutting units of the two blades are moved to slide past each other.

2. The scissors of claim 1, wherein the cutting unit of each blade includes a wave-like cutting edge including a plurality of waves and a series of teeth, such that each wave of the wave-like cutting edge of each blade includes a plurality of said teeth.

3. A scissors, comprising:

two blades pivoted together in a middle portion thereof, each blade having a handle unit at one end and a cutting unit at an opposite end, wherein the cutting unit of at least one blade has a wave-like cutting edge including a series of teeth along the cutting edge, wherein the wave-like cutting edge of said cutting unit holds down a thing to be cut when the cutting units of the two blades are moved to slide past each other, wherein the series of teeth on the wave-like cutting edge on the cutting unit of at least one blade includes a series of smooth-edged teeth longitudinally aligned at one end of the cutting unit, and a series of sharp-edged teeth longitudinally aligned between the series of smooth-edged teeth and the handle unit of the blade.

4. A scissors, comprising:

two blades pivoted together in a middle portion thereof, each blade having a handle unit at one end and a cutting unit at an opposite end, wherein the cutting unit of each blade has a wave-like cutting edge including a series of teeth along the cutting edge, wherein the wave-like cutting edge of said cutting unit holds down a thing to be cut when the cutting units of the two blades are moved to slide past each other, wherein the wave-like cutting edge on the cutting unit of each blade includes a series of smooth-edged teeth longitudinally aligned at one end of the cutting unit, and a series of sharp-edged teeth longitudinally aligned between the series of smooth-edged teeth and the handle unit of the blade.

* * * * *